US012559693B2

(12) United States Patent
Nakamura

(10) Patent No.: US 12,559,693 B2
(45) Date of Patent: Feb. 24, 2026

(54) HEAT TREATMENT OIL

(71) Applicant: IDEMITSU KOSAN CO.,LTD., Chiyoda-ku (JP)

(72) Inventor: Masashi Nakamura, Yokkaichi (JP)

(73) Assignee: IDEMITSU KOSAN CO. , LTD., Chiyoda-ku (JP)

( * ) Notice: Subject to any disclaimer, the term of this patent is extended or adjusted under 35 U.S.C. 154(b) by 0 days.

(21) Appl. No.: 18/552,484

(22) PCT Filed: Mar. 29, 2022

(86) PCT No.: PCT/JP2022/015710
§ 371 (c)(1),
(2) Date: Sep. 26, 2023

(87) PCT Pub. No.: WO2022/210795
PCT Pub. Date: Oct. 6, 2022

(65) Prior Publication Data

US 2024/0174936 A1 May 30, 2024

(30) Foreign Application Priority Data

Mar. 31, 2021 (JP) ..... 2021-062413

(51) Int. Cl.
*C10M 101/02* (2006.01)
*C10N 40/20* (2006.01)

(52) U.S. Cl.
CPC ..... *C10M 101/02* (2013.01); *C10N 2040/20* (2013.01)

(58) Field of Classification Search
CPC ..... C10M 101/02; C10M 2203/1045; C10M 2203/1065; C10N 2040/20;
(Continued)

(56) References Cited

U.S. PATENT DOCUMENTS 3,853,638 A * 12/1974 Wilpers ..... C10M 1/08 148/29
5,250,122 A * 10/1993 Uchida ..... C10M 135/04 148/29

(Continued)

FOREIGN PATENT DOCUMENTS

CN 102212662 A 10/2011
EP 0 113 157 A1 7/1984

(Continued)

OTHER PUBLICATIONS

International Search Report issued Jun. 21, 2022 in PCT/JP2022/015710, 3 pages.

(Continued)

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A quench oil may be excellent in thermal stability and may be capable of retaining the brightness for a prolonged period of time. Such a quench oil may contain a base oil containing a mineral oil (A), the mineral oil (A) having a 40° C. kinematic viscosity of 100 to 600 $mm^2/s$ and a sulfur content of 0.10 to 0.20% by mass, the base oil having a content of the mineral oil (A) of more than 0.5% by mass, based on the total amount of the base oil.

13 Claims, 1 Drawing Sheet

(58) Field of Classification Search
CPC ..... C10N 2020/02; C10N 2030/02; C10N 2030/04; C10N 2030/14; C10N 2030/43; C10N 2040/246; C21D 1/58
USPC ..... 208/19
See application file for complete search history.

(56) References Cited

U.S. PATENT DOCUMENTS

| | | | | |
|---|---|---|---|---|
| 2003/0096714 | A1 | 5/2003 | Nakamura | |
| 2003/0144157 | A1 | 7/2003 | Nakamura | |
| 2007/0191241 | A1* | 8/2007 | Ichitani | C21D 1/58 508/591 |
| 2014/0373584 | A1* | 12/2014 | Takagi | C10M 173/00 508/519 |

FOREIGN PATENT DOCUMENTS

| | | | |
|---|---|---|---|
| JP | 6-136435 | A | 5/1994 |
| JP | 7-70632 | A | 3/1995 |
| JP | 2001-192689 | A | 7/2001 |
| JP | 2010-255058 | A | 11/2010 |
| JP | 2013-213243 | A | 10/2013 |

OTHER PUBLICATIONS

Written Opinion issued Jun. 21, 2022 in PCT/JP2022/015710, 4 pages.
Office Action issued Dec. 3, 2024, in corresponding Japanese Patent Application No. 2021-062413 (with English Translation), 6 pages.
Combined Taiwanese Office Action and Search Report issued Sep. 23, 2025 in Taiwanese Patent Application No. 111112287 (with unedited computer-generated English translation), 12 pages.

* cited by examiner

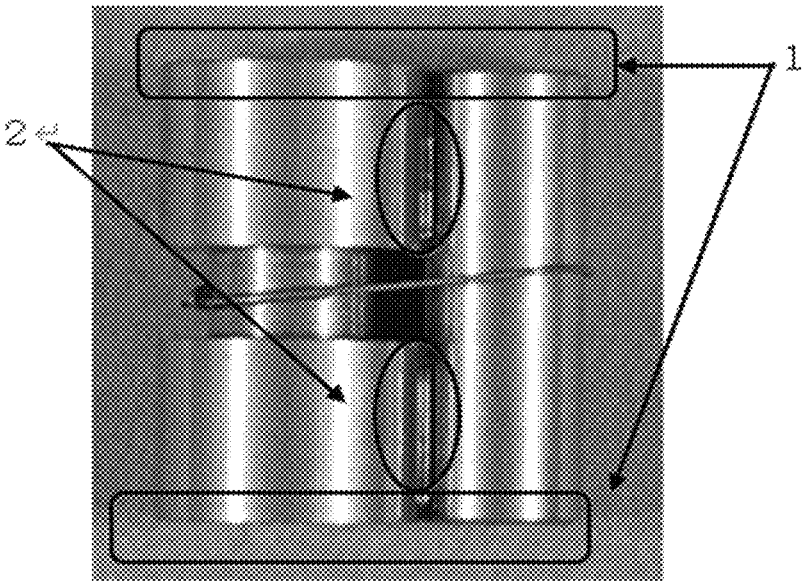
1
2

HEAT TREATMENT OIL

CROSS-REFERENCE TO RELATED APPLICATIONS

The present application is the national stage of international application PCT/JP2022/015710, filed on Mar. 29, 2022, and claims the benefit of the filing date of Japanese Appl. No. 2021-062413, filed on Mar. 31, 2021.

TECHNICAL FIELD

The present invention relates to a heat treating oil.

BACKGROUND ART

Metal materials, such as a steel material, may be subjected to heat treatments, such as quenching, tempering, annealing, and normalizing, for the purpose of improving the properties thereof. In these heat treatments, quenching is a treatment of immersing a heated metal material into a cooling medium to transform into the prescribed hardened structure. The metal material becomes significantly hard through the quenching, and the mechanical strength thereof is enhanced.

A heat treating oil composition has been widely used as the cooling medium for quenching. The heat treating oil composition is demanded to have a capability as a cooling medium, and also a capability of retaining the surface glossiness of the metal material before quenching even after the quenching, from the standpoint of enhancing the market value of the metal material after quenching. Accordingly, the heat treating oil composition is demanded to have a capability of improving the brightness of a metal material after quenching.

For example, PTL 1 proposes that the use of a heat treating oil composition containing a base oil obtained by blending at least one kind of a mineral oil and a synthetic oil each having a sulfur content of 300 ppm by mass or less and at least one kind of sulfur and a sulfur compound to regulate the total sulfur content to 3 ppm by mass to 1,000 ppm by mass, and at least one kind selected from the group consisting of an alkaline earth metal salt of sulfonic acid, an alkaline earth metal salt of phenol, an alkenylsuccinic acid derivative, a fatty acid, a fatty acid derivative, a phenol-based antioxidant, and an amine-based antioxidant improves the brightness of a metal material after quenching.

CITATION LIST

Patent Literature

PTL 1: JP 7-070632 A

SUMMARY OF INVENTION

Technical Problem

However, as a result of the investigations by the present inventors, even the heat treating oil having these additives added thereto has a problem in thermal stability and a problem of difficulty in retaining the brightness for a prolonged period of time.

The present invention has been made in view of the problems, and a problem thereof is to provide a heat treating oil that is excellent in thermal stability and is capable of retaining the brightness for a prolonged period of time.

Solution to Problem

As a result of the earnest investigations by the present inventors, it has been found that the problems can be solved by a heat treating oil having a particular mineral oil blended therein, and thus the present invention has been completed.

Specifically, the present invention provides the following items [1] and [2].

[1] A heat treating oil containing a base oil containing a mineral oil (A), the mineral oil (A) having a 40° C. kinematic viscosity of 100 to 600 $mm^2/s$ and a sulfur content of 0.10 to 0.20% by mass, the base oil having a content of the mineral oil (A) of more than 0.5% by mass based on the total amount of the base oil.

[2] A method for producing a metal material, including performing a high temperature hardening treatment including a cooling step of cooling a heated metal material by immersing in the heat treating oil according to the item [1] retained to an oil temperature of 120° C. or more.

Advantageous Effects of Invention

The present invention can provide a heat treating oil that is excellent in thermal stability and is capable of retaining the brightness for a prolonged period of time.

BRIEF DESCRIPTION OF DRAWING

FIG. 1 is a diagram showing positions of "edge" and "contact site" visually observed for a test piece used in the examples.

DESCRIPTION OF EMBODIMENTS

The upper limit values and the lower limit values of numerical ranges described in the description herein each can be optionally combined. For example, in the case where numerical ranges "A to B" and "C to D" are described, numerical ranges of "A to D" and "C to B" are also encompassed in the scope of the present invention.

The numerical range "(lower limit value) to (upper limit value)" described in the description herein means the lower limit value or more and the upper limit value or less unless otherwise indicated.

In the description herein, the numerals shown in the examples are numerals that can be used as an upper limit value or a lower limit value.

[Heat Treating Oil]

The heat treating oil of the present embodiment is a heat treating oil containing a base oil containing a mineral oil (A), the mineral oil (A) has a 40° C. kinematic viscosity of 100 to 600 $mm^2/s$ and a sulfur content of 0.10 to 0.20% by mass, and the content of the mineral oil (A) is more than 0.5% by mass based on the total amount of the base oil.

As a result of the earnest investigations by the present inventors for solving the problems, it has been found that a heat treating oil that is excellent in thermal stability and is capable of retaining the brightness for a prolonged period of time can be provided by the sulfur component contained in the particular mineral oil, and thus the present invention has been completed.

The components contained in the heat treating oil of the present embodiment will be described below.

<Base Oil>

The heat treating oil of the present embodiment contains a base oil.

The base oil contains at least a mineral oil (A), and may further contain a mineral oil (B) and an additional base oil component.

The base oil preferably has a total content of the mineral oil (A) and the mineral oil (B) of 80% by mass or more, more preferably 90% by mass or more, further preferably 95% by mass or more, and particularly preferably 98% by mass or more, and is particularly preferably formed only of the mineral oil (A) or only of the mineral oil (A) and the mineral oil (B).

In the case where the base oil is formed only of the mineral oil (A) and the mineral oil (B), it is preferred that the content of the mineral oil (A) is 0.8 to 99.2% by mass based on the total amount of the base oil, and the content of the mineral oil (B) is 0.8 to 99.2% by mass based on the total amount of the base oil.

In the heat treating oil of the present embodiment, the content of the base oil is preferably 80.0% by mass or more, more preferably 85.0% by mass or more, and further preferably 87.0% by mass or more, based on the total amount of the heat treating oil.

<Mineral Oil (A)>

The mineral oil (A) used may be one or more kind selected from mineral oils ordinarily used as a base oil of a lubricating oil that have a 40° C. kinematic viscosity of 100 to 600 $mm^2/s$ and a sulfur content of 0.10 to 0.20% by mass.

Examples of the mineral oil (A) include an atmospheric residual oil obtained by subjecting a crude oil, such as a paraffin base crude oil, an intermediate base crude oil, and a naphthene base crude oil, to atmospheric distillation; a distillate oil obtained by subjecting the atmospheric residual oil to distillation under reduced pressure; and a mineral oil obtained by subjecting the distillate oil to one or more refining treatment of solvent deasphalting, solvent extraction, hydrorefining, hydrocracking, higher hydrocracking, solvent dewaxing, catalytic dewaxing, hydrogenation isomerization dewaxing, and the like.

The mineral oil (A) used is preferably a distillate oil obtained by subjecting an atmospheric residual oil obtained by subjecting a naphthene base crude oil to atmospheric distillation further to distillation under reduced pressure, and particularly preferably an oil obtained by subjecting the distillate oil to solvent refining.

The mineral oil (A) may be an oil obtained by subjecting the distillate oil to a hydrogenation treatment to such a range that can exert the effects of the present invention, or the distillate oil that is not subjected to a hydrogenation treatment, and is particularly preferably the distillate oil that is not subjected to a hydrogenation treatment. The avoidance of the hydrogenation treatment to the distillate oil can provide a mineral oil containing the particular sulfur compound contained in the distillate oil improving the brightness through formation of the appropriate sulfide film on the surface of the metal material in the heat treatment, which is preferably used in the heat treating oil of the present embodiment.

Accordingly, the mineral oil (A) is preferably an oil that is obtained by subjecting a distillate oil obtained by subjecting an atmospheric residual oil obtained by subjecting a naphthene base crude oil to atmospheric distillation further to distillation under reduced pressure, further to solvent refining, not subjected to a hydrogenation treatment, such as hydrofinishing, hydrocracking, higher hydrocracking, and hydrogenation isomerization dewaxing.

The kinematic viscosity of the mineral oil (A) is preferably in the following range from the standpoint of improving the cooling capability for the upper limit value and the standpoint of retaining a high flash point and achieving a heat treating oil suppressed in generation of soot for the lower limit value.

The 40° C. kinematic viscosity of the mineral oil (A) is necessarily 100 $mm^2/s$ or more, preferably 110 $mm^2/s$ or more, and more preferably 120 $mm^2/s$ or more, and is necessarily 600 $mm^2/s$ or less, preferably 550 $mm^2/s$ or less, and more preferably 500 $mm^2/s$ or less. The upper limit values and the lower limit values of these numerical ranges can be optionally combined, and specifically the 40° C. kinematic viscosity thereof is necessarily 100 $mm^2/s$ to 600 $mm^2/s$, preferably 110 $mm^2/s$ to 550 $mm^2/s$, and more preferably 120 $mm^2/s$ to 500 $mm^2/s$.

The 100° C. kinematic viscosity of the mineral oil (A) is preferably 3.0 $mm^2/s$ or more, more preferably 5.0 $mm^2/s$ or more, and further preferably 7.0 $mm^2/s$ or more, and is preferably 50.0 $mm^2/s$ or less, more preferably 40.0 $mm^2/s$ or less, and further preferably 30.0 $mm^2/s$ or less. The upper limit values and the lower limit values of these numerical ranges can be optionally combined, and specifically the 100° C. kinematic viscosity thereof is preferably 3.0 $mm^2/s$ to 50.0 $mm^2/s$, more preferably 5.0 $mm^2/s$ to 40.0 $mm^2/s$, and further preferably 7.0 $mm^2/s$ to 30.0 $mm^2/s$.

The 40° C. kinematic viscosity and the 100° C. kinematic viscosity each can be measured according to JIS K2283: 2000.

The mineral oil (A) preferably has a % $C_N$ according to ring analysis (n-d-M method) of 29.0 to 47.0, more preferably 30.0 to 45.0, and further preferably 32.0 to 43.0, from the standpoint of selecting a mineral oil containing the particular sulfur compound.

Similarly, the mineral oil (A) preferably has a % $C_A$ according to ring analysis (n-d-M method) of 5.0 to 25.0, more preferably 8.0 to 22.0, and further preferably 11.0 to 20.0.

In the description herein, the ring analysis (n-d-M method) is performed according to ASTM D3238-95.

In the heat treating oil of the present embodiment, the content of the mineral oil (A) is necessarily more than 0.5% by mass, preferably 0.7 to 100% by mass, more preferably 0.8 to 100% by mass, and further preferably 0.9 to 100% by mass, based on the total amount (100% by mass) of the base oil.

As described above, the mineral oil (A) used in the present embodiment has a sulfur content of 0.10 to 0.20% by mass based on the total amount of the mineral oil (A), and the sulfur content means a value that is measured according to the wavelength-dispersive X-ray spectroscopy of JIS K2541-7:2013.

The sulfur content of the mineral oil (A) is preferably 0.11 to 0.17% by mass.

<Mineral Oil (B)>

The base oil may contain a mineral oil (B) in addition to the mineral oil (A)

The mineral oil (B) used may be one or more kind selected from mineral oils having been used as a base oil of a lubricating oil, and necessarily has a sulfur content of 100 ppm by mass or less based on the total amount of the mineral oil (B). In the case where the sulfur content thereof exceeds 100 ppm by mass, there is a concern that the sulfur compound contained in the mineral oil sulfurizes and discolors the surface of a metal material in the heat treatment.

Examples of the mineral oil (B) include an atmospheric residual oil obtained by subjecting a crude oil, such as a paraffin base crude oil, an intermediate base crude oil, and a naphthene base crude oil, to atmospheric distillation; a distillate oil obtained by subjecting the atmospheric residual oil to distillation under reduced pressure; and a mineral oil obtained by subjecting the distillate oil to one or more refining treatment of solvent deasphalting, solvent extraction, hydrorefining, hydrocracking, higher hydrocracking, solvent dewaxing, catalytic dewaxing, hydrogenation isomerization dewaxing, and the like.

<Additional Base Oil Component>

The base oil may contain an additional base oil component in addition to the mineral oil (A) and the mineral oil (B).

The additional base oil component is not particularly limited, as far as the component does not correspond to the mineral oil (A) and the mineral oil (B). Examples thereof include an atmospheric residual oil obtained by subjecting a crude oil, such as a paraffin base crude oil, an intermediate base crude oil, and a naphthene base crude oil, to atmospheric distillation; a distillate oil obtained by subjecting the atmospheric residual oil to distillation under reduced pressure; and a mineral oil obtained by subjecting the distillate oil to one or more refining treatment of solvent deasphalting, solvent extraction, hydrorefining, hydrocracking, higher hydrocracking, solvent dewaxing, catalytic dewaxing, hydrogenation isomerization dewaxing, and the like, and various synthetic oils may also be used.

<Sulfur-Containing Synthetic Additive>

The heat treating oil of the present embodiment may contain a sulfur-containing synthetic additive, and the content thereof is preferably less than 100 ppm by mass, and more preferably less than 10 ppm by mass, based on the total amount of the heat treating oil, from the standpoint of improving the thermal stability of the heat treating oil and suppressing the deterioration of the brightness due to the formation of sludge.

Examples of the sulfur-containing synthetic additive include a sulfide compound and a sulfone compound, and accordingly the heat treating oil of the present embodiment preferably has a total content of a sulfide compound and a sulfone compound of less than 100 ppm by mass, and more preferably less than 10 ppm by mass, based on the total amount of the heat treating oil.

<Additive>

The heat treating oil of the present embodiment may contain an additive having been ordinarily used in heat treating oils depending on desire. Examples of the additive include a vapor blanket collapse agent, a brightness improver, an antioxidant, and a detergent dispersant, and one or more kind selected therefrom may be used.

Accordingly, the heat treating oil of the present embodiment may be a heat treating oil further containing one or more kind selected from a vapor blanket collapse agent, a brightness improver, an antioxidant, and a detergent dispersant, in addition to the aforementioned base oil, and may also be a heat treating oil formed only of the aforementioned base oil and one or more kind selected from a vapor blanket collapse agent, a brightness improver, an antioxidant, and a detergent dispersant.

(Vapor Blanket Collapse Agent)

Examples of the vapor blanket collapse agent include an ethylene-α-olefin copolymer (wherein the α-olefin has 3 to 20 carbon atoms), such as an ethylene-propylene copolymer; a hydrogenated product of the ethylene-α-olefin copolymer; a polymer of an α-olefin having 5 to 20 carbon atoms, such as 1-hexene, 1-octene, 1-decene, 1-dodecene, 1-tetradecene, 1-hexadecene, and 1-octadecene; a hydrogenated product of the polymer of the α-olefin; a polymer of an olefin having 3 or 4 carbon atoms, such as polypropylene, polybutene, and polyisobutylene; a hydrogenated product of the polymer of the olefin; a polymer compound, such as a polymethacrylate, a polyacrylate, a polystyrene, and a petroleum resin; and asphalt.

One kind of the vapor blanket collapse agent may be used alone, or two or more kinds thereof may be used in combination.

The number average molecular weight (Mn) of the vapor blanket collapse agent is generally preferably 800 to 100,000. The number average molecular weight (Mn) of the vapor blanket collapse agent is a value that is measured by gel permeation chromatography (GPC) as a polystyrene conversion value.

The content of the vapor blanket collapse agent is preferably 0.5% by mass to 18% by mass, more preferably 1.0% by mass to 16% by mass, and further preferably 2.0% by mass to 15% by mass, based on the total amount of the heat treating oil.

(Brightness Improver)

Examples of the brightness improver include fat and oil; a fat and oil fatty acid; an alkylsuccinic acid, such as an alkylsuccinimide; an alkenylsuccinic acid, such as an alkenylsuccinimide; and a substituted hydroxy aromatic carboxylate ester derivative.

One kind of the brightness improver may be used alone, or two or more kinds thereof may be used in combination.

The content of the brightness improver is preferably 0.1% by mass to 5.0% by mass, more preferably 0.3% by mass to 3.0% by mass, further preferably 0.4% by mass to 2.0% by mass, based on the total amount of the heat treating oil.

(Antioxidant)

Examples of the antioxidant include a phenol-based antioxidant and an amine-based antioxidant.

Examples of the phenol-based antioxidant include a monocyclic phenol compound, such as 2,6-di-tert-butyl-4-methylphenol, 2,4,6-tri-tert-butylphenol, 2,6-di-tert-butyl-4-ethylphenol, 2,6-di-tert-butylphenol, 2,6-di-tert-butyl-4-hydroxymethylphenol, 2,4-dimethyl-6-tert-butylphenol, 2,6-di-tert-butyl-4-(N,N-dimethylaminomethyl) phenol, 2,6-di-tert-amyl-4-methylphenol, and n-octadecyl-3-(4-hydroxy-3,5-di-tert-butylphenyl) propionate; and a polycyclic phenol compound, such as 4,4'-methylenebis(2,6-di-tert-butylphenol), 4,4'-isopropylidenebis(2,6-di-tert-butylphenol), 2,2'-methylenebis(4-methyl-6-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 4,4'-butylidenebis(3-methyl-6-tert-butylphenol), 2,2'-thiobis(4-methyl-6-tert-butylphenol), and 4,4'-thiobis(3-methyl-6-tert-butylphenol).

Examples of the amine-based antioxidant include a diphenylamine-based antioxidant and a naphthylamine-based antioxidant.

Examples of the diphenylamine-based antioxidant include an alkylated diphenylamine having an alkyl group having 3 to 20 carbon atoms, and specific examples thereof include diphenylamine, monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine, and tetranonyldiphenylamine.

Examples of the naphthylamine-based antioxidant include a phenyl-α-naphthylamine substituted by an alkyl group having 3 to 20 carbon atoms, and specific examples thereof include α-naphthylamine, phenyl-α-naphthylamine, butylphenyl-α-naphthylamine, hexylphenyl-α-naphthylamine, octylphenyl-α-naphthylamine, and nonylphenyl-α-naphthylamine.

One kind of the antioxidant may be used alone, or two or more kinds thereof may be used in combination.

The content of the antioxidant is preferably 0.01% by mass to 5.0% by mass, more preferably 0.05% by mass to 3.0% by mass, and further preferably 0.1% by mass to 2.0% by mass, based on the total amount of the heat treating oil.

(Detergent Dispersant)

The detergent dispersant used may be one or more kind selected from the group consisting of a metal-based detergent and an ashless dispersant.

Examples of the metal-based detergent include a metal sulfonate, a metal salicylate, and a metal phenate.

Examples of the metal constituting the metal-based detergent include an alkali metal, such as sodium and patassium, and an alkaline earth metal, such as magnesium, calcium, and barium.

Examples of the ashless dispersant include an alkenylsuccinimide compound, a boron-containing alkenylsuccinimide compound, a benzylamine compound, a boron-containing benzylamine compound, a succinate ester compound, and a monovalent or divalent carboxylic amide represented by a fatty acid or succinic acid.

One kind of the detergent dispersant may be used alone, or two or more kinds thereof may be used in combination.

The content of the detergent dispersant may be 0.01% by mass to 5.0% by mass based on the total amount of the heat treating oil.

[Property Values of Heat Treating Oil]

<Sulfur Content>

The heat treating oil of the present embodiment preferably has a sulfur content of 5 ppm by mass to 2,000 ppm by mass, more preferably 8 ppm by mass to 800 ppm by mass, and further preferably 10 ppm by mass to 500 ppm by mass, based on the total amount of the heat treating oil composition.

<40° C. Kinematic Viscosity>

The 40° C. kinematic viscosity of the heat treating oil of the present embodiment is set corresponding to the target oil temperature in a heat treatment, such as quenching.

Heat treating oils are classified into a cold oil used at a low oil temperature, a hot oil used at a high oil temperature, and a semi-hot oil used at an oil temperature therebetween. The cold oil is classified into Type 1 of JIS K2242: 2012, and the semi-hot oil and the hot oil are classified into Type 2 of JIS K2242: 2012.

In the case where the heat treating oil of the present embodiment is used as a cold oil, the 40° C. kinematic viscosity thereof is preferably 5 $mm^2/s$ or more and less than 40 $mm^2/s$.

In the case where the heat treating oil of the present embodiment is used as a semi-hot oil or a hot oil, the 40° C. kinematic viscosity thereof is more preferably 40 $mm^2/s$ or more and 500 $mm^2/s$ or less.

[Method for Producing Heat Treating Oil]

The method for producing the heat treating oil of the present embodiment is not particularly limited.

In the method for producing the heat treating oil of the present embodiment, the mineral oil (A) that satisfies the 40° C. kinematic viscosity and the sulfur content described above may be used directly as a heat treating oil, and the production method may include a step of mixing the mineral oil (A) with the mineral oil (B) and one or more kind selected from the group consisting of the additional base oil components and the additives.

[Applications of Heat Treating Oil]

The heat treating oil of the present embodiment can be used in a heat treatment, such as quenching, of a metal material, and thereby the brightness of the metal material after the heat treatment, such as quenching, can be improved. For example, the heat treating oil can be favorably used as a heat treating oil composition in performing a heat treatment, such as quenching, of various alloy steels, such as a carbon steel, a nickel-manganese steel, a chromium molybdenum steel, and a manganese steel.

Accordingly, the present invention also provides a heat treatment method of a metal material, including using the heat treating oil of the present embodiment in a heat treatment, such as quenching, of a metal material. At this time, the oil temperature of the heat treating oil in the case where the heat treatment is a high temperature hardening treatment is preferably set to 120° C. or more, and more preferably 170° C. to 250° C.

[Method for Producing Metal Material]

The method for producing a metal material of the present embodiment includes performing a high temperature hardening treatment including a cooling step of cooling a heated metal material by immersing in the heat treating oil retained to an oil temperature of 120° C. or more.

The oil temperature in the cooling step is more preferably retained to 170° C. to 250° C.

[Embodiments Provided by Present Invention]

The present invention provides embodiments of the following items [1] to [7].

[1] A heat treating oil containing a base oil containing a mineral oil (A), the mineral oil (A) having a 40° C. kinematic viscosity of 100 to 600 $mm^2/s$ and a sulfur content of 0.10 to 0.20% by mass, the base oil having a content of the mineral oil (A) of more than 0.5% by mass based on the total amount of the base oil.

[2] The heat treating oil according to the item [1], wherein the mineral oil (A) has a % $C_A$ according to n-d-M ring analysis of 5.0 to 25.0.

[3] The heat treating oil according to the item [1] or [2], wherein the base oil contains the mineral oil (A) in a content of 0.7 to 100% by mass based on the total amount of the base oil.

[4] The heat treating oil according to any one of the items [1] to [3], wherein the heat treating oil has a content of a sulfur-containing synthetic additive of less than 100 ppm by mass based on the total amount of the heat treating oil.

[5] The heat treating oil according to any one of the items [1] to [4], wherein the base oil further contains a mineral oil (B) having a sulfur content of 100 ppm by mass or less.

[6] The heat treating oil according to the item [5], wherein the base oil has a content of the mineral oil (A) of 0.8 to 99.2% by mass based on the total amount of the base oil, and the base oil has a content of the mineral oil (B) of 0.8 to 99.2% by mass based on the total amount of the base oil.

[7] A method for producing a metal material, including performing a high temperature hardening treatment including a cooling step of cooling a heated metal material by immersing in the heat treating oil according to any one of the items [1] to [6] retained to an oil temperature of 120° C. or more.

EXAMPLES

The present invention will be described specifically with reference to examples below, but the present invention is not limited to the following examples.

The properties of the components used in Examples and Comparative Examples and the heat treating oils obtained therein were measured by the following methods.

[40° C. Kinematic Viscosity and 100° C. Kinematic Viscosity]

The 40° C. kinematic viscosity and the 100° C. kinematic viscosity of the mineral oils and heat treating oils were measured or calculated according to JIS K2283: 2000.

[Sulfur Content]

The sulfur contents of the mineral oils (A), the mineral oils (B), and the additional mineral oils used in Examples and Comparative Examples, and the heat treating oils prepared in Examples and Comparative Examples were measured according to the ultraviolet fluorescent method of JIS K2541-6:2013 for the measurement of amounts of less than 0.05% by mass (500 ppm by mass), or according to the wavelength dispersive X-ray spectroscopy of JIS K2541-7: 2013 for the measurement of amounts of 0.05% by mass (500 ppm by mass) or more.

Examples 1 to 8 and Comparative Examples 1 to 9

The components shown below were blended at the contents shown in Tables 1 and 2 and sufficiently mixed to provide heat treating oils.

The details of the components used in Examples 1 to 8 and Comparative Examples 1 to 9 are shown below.

<Mineral Oil (A)>

Mineral oil A1 (obtained by subjecting a lubricating oil fraction obtained by distillation under reduced pressure of a naphthene base crude oil to solvent extraction, 40° C. kinematic viscosity: 137.3 $mm^2/s$, 100° C. kinematic viscosity: 10.02 $mm^2/s$, sulfur content: 0.12% by mass, naphthene content (% $C_N$): 41.5, aromatic content (% $C_A$): 13.1)

Mineral oil A2 (obtained by subjecting a lubricating oil fraction obtained by distillation under reduced pressure of a naphthene base crude oil to solvent extraction, 40° C. kinematic viscosity: 316.2 $mm^2/s$, 100° C. kinematic viscosity: 16.52 $mm^2/s$, sulfur content: 0.14% by mass, naphthene content (% $C_N$): 36.0, aromatic content (% $C_A$): 15.5)

Mineral oil A3 (obtained by subjecting a lubricating oil fraction obtained by distillation under reduced pressure of a naphthene base crude oil to solvent extraction, 40° C. kinematic viscosity: 480.8 $mm^2/s$, 100° C. kinematic viscosity: 22.19 $mm^2/s$, sulfur content: 0.16% by mass, naphthene content (% $C_N$): 33.7, aromatic content (% $C_A$): 14.4)

<Mineral Oil (B)>

Mineral oil B1 (obtained by mixing a deasphalted oil obtained by subjecting a reduced pressure distillation residual oil to solvent deasphaltation, with a lubricating oil fraction obtained by atmospheric distillation and distillation under reduced pressure of an intermediate base crude oil, followed by subjecting to hydrocracking, 40° C. kinematic viscosity: 408.8 $mm^2/s$, 100° C. kinematic viscosity: 30.88 $mm^2/s$, sulfur content: less than 100 ppm by mass, naphthene content (% $C_N$): 27.0, aromatic content (% $C_A$): 0.0)

Mineral oil B2 (obtained by subjecting a lubricating oil fraction obtained by atmospheric distillation and distillation under reduced pressure of an intermediate base crude oil to hydrocracking, 40° C. kinematic viscosity: 89.41 $mm^2/s$, 100° C. kinematic viscosity: 10.70 $mm^2/s$, sulfur content: less than 100 ppm by mass, naphthene content (% $C_N$): 25.5, aromatic content (% $C_A$): 3.7)

Mineral oil B3 (obtained by mixing a deasphalted oil obtained by subjecting a reduced pressure distillation residual oil to solvent deasphaltation, with a lubricating oil fraction obtained by atmospheric distillation and distillation under reduced pressure of an intermediate base crude oil, followed by subjecting to hydrocracking, 40° C. kinematic viscosity: 441.6 $mm^2/s$, 100° C. kinematic viscosity: 32.07 $mm^2/s$, sulfur content: 96 ppm by mass, naphthene content (% $C_N$): 25.1, aromatic content (% $C_A$): 3.6)

<Additional Mineral Oil>

Mineral oil C1 (obtained by subjecting a deasphalted oil obtained by subjecting a reduced pressure distillation residual oil obtained by atmospheric distillation and distillation under reduced pressure of an intermediate base crude oil to solvent deasphaltation, to solvent extraction and then hydrofinishing, 40° C. kinematic viscosity: 495.8 $mm^2/s$, 100° C. kinematic viscosity: 31.79 $mm^2/s$, sulfur content: 1.18% by mass, naphthene content (% $C_N$): 23.3, aromatic content (% $C_A$): 7.0)

Mineral oil C2 (obtained by subjecting a deasphalted oil obtained by subjecting a reduced pressure distillation residual oil obtained by atmospheric distillation and distillation under reduced pressure of an intermediate base crude oil to solvent deasphaltation, to solvent extraction and then hydrofinishing, 40° C. kinematic viscosity: 479.5 $mm^2/s$, 100° C. kinematic viscosity: 31.65 $mm^2/s$, sulfur content: 0.47% by mass, naphthene content (% $C_N$): 23.6, aromatic content (% $C_A$): 5.8)

Mineral oil C3 (obtained by subjecting a lubricating oil fraction obtained by atmospheric distillation and distillation under reduced pressure of an intermediate base crude oil to solvent extraction and then hydrofinishing, 40° C. kinematic viscosity: 20.10 $mm^2/s$, 100° C. kinematic viscosity: 4.070 $mm^2/s$, sulfur content: 1,000 ppm by mass, naphthene content (% $C_N$): 28.2, aromatic content (% $C_A$): 4.9)

Mineral oil C4 (obtained by subjecting a lubricating oil fraction obtained by atmospheric distillation and distillation under reduced pressure of an intermediate base crude oil to solvent extraction and then hydrofinishing, 40° C. kinematic viscosity: 102.5 $mm^2/s$, 100° C. kinematic viscosity: 11.300 $mm^2/s$, sulfur content: 5,300 ppm by mass, naphthene content (% $C_N$): 24.1, aromatic content (% $C_A$): 7.0)

Mineral oil C5 (obtained by subjecting a lubricating oil fraction obtained by distillation under reduced pressure of a naphthene base crude oil to solvent extraction, 40° C. kinematic viscosity: 27.13 $mm^2/s$, 100° C. kinematic viscosity: 4.158 $mm^2/s$, sulfur content: 700 ppm by mass, naphthene content (% $C_N$): 47.3, aromatic content (% $C_A$): 10.2)

The raw materials above were sufficiently mixed in the blending amount (% by mass) shown in Tables 1 and 2 to prepare heat treating oils of Examples 1 to 8 and Comparative Examples 1 to 9, which were then subjected to the brightness evaluation and the thermal stability evaluation shown below.

<Brightness Evaluation>

The brightness of the steel material after quenching was evaluated with reference to "Influence of Oxygen in Heat treating oils Tank on Brightness (Idemitsu Tribo Review, No. 31, pp. 1963-1966, published on September 30, Heisei 20 (2008)).

Specifically, a dumbbell specimen of S45C Steel (diameter: 16 mm, length: 30 mm, hardness $H_{RC}$: 16) and a cylindrical specimen of SUJ2 Steel (diameter: 10 mm, length: 30 mm, hardness $H_{RC}$: 15) were combined to prepare a test piece. In more detail, the dumbbell specimen of S45C Steel and the cylindrical specimen of SUJ2 Steel were banded by tying with a SUS 303 wire at the center (see FIG. 1). A quenching test was performed in such a manner that the test piece was heated in a furnace having a mixed gas atmosphere of nitrogen and hydrogen, and then the test piece was quenched by placing in a heat treating oil composition.

The condition of the quenching test was as follows.

(Test Assuming Hot Oil)

Furnace temperature: 850° C.

Test piece retention time in furnace: 40 minutes after furnace temperature reached 850° C.

Temperature of heat treating oil: 120° C.

Immersion time of test piece in heat treating oil (quenching time): 10 minutes

The test piece after quenching was evaluated for brightness focusing on the "brightness", the "coloration at edge", and the "coloration at contact site" based on the following standard. The brightness of the test piece was comprehensively evaluated by the following standard based on the evaluation results of the "brightness", the "coloration at edge", and the "coloration at contact site".

(Brightness)

An appearance sample having been colored as prescribed was produced, and the color of the quenched test piece was evaluated by visually comparing therewith. The extent of coloration of the appearance sample is shown by the following numerals.

0: No coloration

1: Pale coloration

2: Blackish brown to black coloration (Coloration at Edge)

The edge of the test piece (see FIG. 1) was visually observed and evaluated by the following standard.

0: No or substantially no coloration

1: Pale coloration

2: Blackish brown to black coloration (Coloration at Contact Site)

The test piece (at the contact site of the dumbbell steel specimen and the cylindrical steel specimen, see FIG. 1) was visually observed and evaluated by the following standard.

0: No or substantially no coloration

1: Pale coloration

2: Blackish brown to black coloration (Comprehensive Evaluation of Brightness)

The comprehensive evaluation was performed by using the evaluation results of the "brightness", the "coloration at edge", and the "coloration at contact site" based on the following standard.

Evaluation S: The sum of the evaluation results of the "brightness", the "coloration at edge", and the "coloration at contact site" was 0.

Evaluation A: The sum of the evaluation results of the "brightness", the "coloration at edge", and the "coloration at contact site" was 1.

Evaluation B: The sum of the evaluation results of the "brightness", the "coloration at edge", and the "coloration at contact site" was 2.

Evaluation C: The sum of the evaluation results of the "brightness", the "coloration at edge", and the "coloration at contact site" was 3 or more.

In the case where the evaluation result of any one of the "brightness", the "coloration at edge", and the "coloration at contact site" was 2 or more, the evaluation was designated as C.

The heat treating oil composition of the evaluation S is significantly excellent in brightness. The heat treating oil composition of the evaluation A is excellent in brightness. On the other hand, the heat treating oil composition of the evaluation B is slightly inferior in brightness. The heat treating oil composition of the evaluation C is inferior in brightness.

<Thermal Stability Evaluation>

According to the thermal stability test of JIS 2540, a test oil after 96 hours at 175° C. was visually confirmed, and the formation of sludge was evaluated based on the following standard.

Evaluation A: no sludge found in test oil

Evaluation F: sludge found in test oil

TABLE 1

| | | | Example | | | | | | | |
|---|---|---|---|---|---|---|---|---|---|---|
| | | | 1 | 2 | 3 | 4 | 5 | 6 | 7 | 8 |
| Mineral oil (A) | Mineral oil A1 | % by mass | 100.0 | | | 1.0 | 10.0 | | | 1.0 |
| | Mineral oil A2 | % by mass | | 100.0 | | | | | | |
| | Mineral oil A3 | % by mass | | | 100.0 | | | 1.0 | 10.0 | |
| Mineral oil (B) | Mineral oil B1 | % by mass | | | | 99.0 | 90.0 | 99.0 | 90.0 | |
| | Mineral oil B2 | % by mass | | | | | | | | |
| | Mineral oil B3 | % by mass | | | | | | | | 99.0 |
| Additional mineral oil | Mineral oil C1 | % by mass | | | | | | | | |
| | Mineral oil C2 | % by mass | | | | | | | | |
| | Mineral oil C3 | % by mass | | | | | | | | |
| | Mineral oil C4 | % by mass | | | | | | | | |
| | Mineral oil C5 | % by mass | | | | | | | | |
| | Total | % by mass | 100.0 | 100.0 | 100.0 | 100.0 | 100.0 | 100.0 | 100.0 | 100.0 |
| Property value | 40° C. Kinematic viscosity | $mm^2/s$ | 137.3 | 316.2 | 480.8 | 403.9 | 362.9 | 409.5 | 415.4 | 435.8 |
| | 100° C. Kinematic viscosity | $mm^2/s$ | 10.02 | 16.52 | 22.19 | 30.43 | 27.70 | 30.77 | 29.84 | 31.63 |
| | Sulfur content | | 0.12 % by mass | 0.14 % by mass | 0.16 % by mass | 15 ppm by mass | 126 ppm by mass | 20 ppm by mass | 162 ppm by mass | 110 ppm by mass |
| Evaluation result | Brightness | — | S | S | S | S | S | S | S | S |
| | Thermal stability | — | A | A | A | A | A | A | A | A |

TABLE 2

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Mineral oil (A) | Mineral oil A1 | % by mass | | | | | | | | 0.5 | |
| | Mineral oil A2 | % by mass | | | | | | | | | |
| | Mineral oil A3 | % by mass | | | | | | | | | 0.5 |
| Mineral oil (B) | Mineral oil B1 | % by mass | 100.0 | | | | | | | 99.5 | 99.5 |
| | Mineral oil B2 | % by mass | | 100.0 | | | | | | | |
| | Mineral oil B3 | % by mass | | | | | | | | | |
| Additional mineral oil | Mineral oil C1 | % by mass | | | 100.0 | | | | | | |
| | Mineral oil C2 | % by mass | | | | 100.0 | | | | | |
| | Mineral oil C3 | % by mass | | | | | 100.0 | | | | |
| | Mineral oil C4 | % by mass | | | | | | 100.0 | | | |
| | Mineral oil C5 | % by mass | | | | | | | 100.0 | | |
| | Total | % by mass | 100.0 | 100.0 | 100.0 | 100.0 | 100.0 | 100.0 | 100.0 | 100.0 | 100.0 |
| Property value | 40° C. Kinematic viscosity | $mm^2/s$ | 408.8 | 89.41 | 495.8 | 479.5 | 20.10 | 102.5 | 27.13 | 406.4 | 409.1 |
| | 100° C. Kinematic viscosity | $mm^2/s$ | 30.88 | 10.70 | 31.79 | 31.79 | 4.070 | 11.30 | 4.158 | 30.68 | 30.83 |
| | Sulfur content | | <100 ppm by mass | <100 ppm by mass | 1.18 % by mass | 0.47 % by mass | 0.10 % by mass | 0.53 % by mass | 0.07 % by mass | 7 ppm by mass | 9 ppm by mass |
| Evaluation result | Brightness | — | C | C | C | C | B | B | B | B | B |
| | Thermal stability | — | A | A | F | F | A | F | A | A | A |

As found from Tables 1 and 2, it is understood that the lubricating oil compositions of Examples 1 to 8 satisfying all the configurations of the present invention are excellent in brightness and thermal stability.

On the other hand, it is understood that the lubricating oil compositions of Comparative Examples 1 to 9 are inferior in brightness and thermal stability to the lubricating oil compositions of Examples 1 to 8.

REFERENCE SIGN LIST

1: Edge

2: Contact site

The invention claimed is:

1. A heat treating oil, comprising:

a base oil comprising a mineral oil (A), wherein the mineral oil (A) has a 40° C. kinematic viscosity in a range of from 100 to 600 $mm^2/s$ and a sulfur content in a range of from 0.11 to 0.20% by mass, and wherein the base oil having a content of the mineral oil (A) of more than 0.5% by mass, based on total base oil mass.

2. The heat treating oil of claim 1, wherein the mineral oil (A) has a % $C_A$ according to n-d-M ring analysis in a range of from 5.0 to 25.0.

3. The heat treating oil of claim 1, wherein the base oil comprises the mineral oil (A) in a content in a range of from 0.7 to 100% by mass, based on the total base oil mass.

4. The heat treating oil of claim 1, wherein the heat treating oil has a content of a sulfur-containing synthetic additive of less than 100 ppm by mass, based on the total heat treating oil mass.

5. The heat treating oil of claim 1, wherein the base oil further comprises a mineral oil (B) having a sulfur content of 100 ppm by mass or less.

6. The heat treating oil of claim 5, wherein, based on the total base oil mass, the base oil comprises the mineral oil (A) in a range of from 0.8 to 99.2% by mass, and the mineral oil (B) in a range of from 0.8 to 99.2% by mass based on the total amount of the base oil.

7. A method for producing a metal material, the method comprising:

performing a high temperature hardening treatment comprising cooling a heated metal material by immersing in the heat treating oil of claim 1 retained to an oil temperature of 120° C. or more.

8. The heat treating oil of claim 1, wherein the mineral oil (A) has a 100° C. kinematic viscosity in a range of from 3.0 to 50.0 $mm^2/s$.

9. The heat treating oil of claim 1, wherein the mineral oil (A) has a % $C_N$ according to n-d-M ring analysis in a range of from 29.0 to 47.0.

10. The heat treating oil of claim 1, wherein the mineral oil (A) is obtained from a distillate oil that is not subjected to a hydrogenation treatment.

11. The heat treating oil of claim 10, wherein the hydrogenation treatment includes hydrofinishing, hydrocracking, higher hydrocracking, and hydrogenation isomerization dewaxing.

12. The heat treating oil of claim 1, wherein the mineral oil (A) is obtained by a method comprising:

subjecting a naphthene base crude oil to atmospheric distillation to obtain an atmospheric residual oil;

subjecting the atmospheric residual oil to distillation under reduced pressure to obtain a distillate oil; and solvent refining the distillate oil to obtain the mineral oil (A), wherein the method does not comprise hydrogenation treatment.

13. The heat treating oil of claim 12, wherein the hydrogenation treatment includes hydrofinishing, hydrocracking, higher hydrocracking, and hydrogenation isomerization dewaxing.

* * * * *